US007386447B2

(12) United States Patent
Li et al.

(10) Patent No.: US 7,386,447 B2
(45) Date of Patent: Jun. 10, 2008

(54) SPEECH CODER AND METHOD

(75) Inventors: Dunling Li, Rockville, MD (US); Gokhan Sisli, Bethesda, MD (US); John T. Dowdal, Gaithersburg, MD (US); Zoran Mladenovic, Bethesda, MD (US)

(73) Assignee: Texas Instruments Incorporated, Dallas, TX (US)

( * ) Notice: Subject to any disclaimer, the term of this patent is extended or adjusted under 35 U.S.C. 154(b) by 1044 days.

(21) Appl. No.: 10/287,572

(22) Filed: Nov. 4, 2002

(65) Prior Publication Data

US 2003/0135363 A1 Jul. 17, 2003

Related U.S. Application Data

(60) Provisional application No. 60/350,274, filed on Nov. 2, 2001.

(51) Int. Cl.
*G10L 21/00* (2006.01)

(52) U.S. Cl. ..... 704/221

(58) Field of Classification Search ..... None
See application file for complete search history.

(56) References Cited

U.S. PATENT DOCUMENTS

| | | | | |
|---|---|---|---|---|
| 5,233,660 | A * | 8/1993 | Chen | 704/208 |
| 6,381,570 | B2 * | 4/2002 | Li et al. | 704/233 |
| 6,697,776 | B1 * | 2/2004 | Fayad et al. | 704/233 |
| 6,711,537 | B1 * | 3/2004 | Beaucoup | 704/220 |
| 6,807,525 | B1 * | 10/2004 | Li et al. | 704/215 |
| 7,031,916 | B2 * | 4/2006 | Li et al. | 704/233 |

OTHER PUBLICATIONS

Benyassine, A, et al., "ITU-T Recommendation G.729 Annex B: A Silence Compression Scheme for Use with G.729 Optimized vor V.70 Digital simultaneous Voice and Data Applications", IEEE Communications Magazine, vol. 35, No. 9, Sep. 1997, pp. 64-73.*

* cited by examiner

*Primary Examiner*—David D. Knepper
(74) *Attorney, Agent, or Firm*—Steven A. Shaw; W. James Brady; Frederick J. Telecky, Jr.

(57) ABSTRACT

An overflow problem of LSF quantization in G.729 Annex B speech encoding which may lead to non-assignment of a codebook index. Preferred embodiments fix the problem with default or limited random variable assignments or flagging the overflow and adjusting the frame encoding such as by limiting spectral components or changing quantization targets.

4 Claims, 1 Drawing Sheet

SPEECH CODER AND METHOD

CROSS-REFERENCE TO RELATED APPLICATIONS

This application claims priority from provisional applications: Ser. No. 60/350,274, filed Nov. 2, 2001. The following patent applications disclose related subject matter: Ser. Nos. 09/699,366, filed Oct. 31, 2000, now U.S. Pat. No. 6,807,525 and Ser. No. 09/871,779, filed Jun. 1, 2001, now U.S. Pat. No. 7,031,916. These referenced applications have a common assignee with the present application.

BACKGROUND OF THE INVENTION

The invention relates to electronic devices, and more particularly to speech encoding, transmission, storage, and decoding/synthesis methods and circuitry.

Commercial digital speech systems and telephony, including wireless and packetized network, continually demand increased speech coding quality and compression. This has led to ITU standardized methods such as G.729 and G.729 Annex A for encoding/decoding speech using a conjugate structure algebraic code-excited linear-prediction (CS-ACELP) method. Further, standard G.729 Annex B provides additional compression for silence frames and is to be used with G.729 and G.729 Annex A. In particular, Annex B provides a voice activity detector (VAD), discontinuous transmission, and comfort noise generator to reduce the transmission bit rate during silence periods, such as pauses during speaking.

G.729 and G.729 Annex A use 10 ms frames, and the Annex B VAD makes a voice activity decision every frame to decide the type of frame encoding; see FIG. 3 which illustrates high level functionality of G.729 Annex B. With voice activity detected, encode the frame with G.729 or G.729 Annex A. However, with no voice activity detected, either transmit a silence insertion descriptor (SID) frame or do not transmit.

SUMMARY OF THE INVENTION

The present invention identifies a problem with G.729 Annex B SID LSF vector quantization.

Preferred embodiment encoding and decoding have advantages including fixes of the problem of G.729 Annex B SID LSF vector quantization.

BRIEF DESCRIPTION OF THE DRAWINGS

The drawings are heuristic for clarity.

DETAILED DESCRIPTION OF THE PREFERRED EMBODIMENTS

1. Overview

The preferred embodiment systems adjust functions of G.729 Annex B to overcome the SID LSF vector quantization overflow problem identified by the invention. In particular, for SID frames rapid spectral change may cause the current frame LSF vector to diverge from the LSF predictor vectors derived from prior frames, and thus the error (difference of current and predictor) LSF vector is large and not close to any of the codebook (quantized) vectors. In this case the G.729 Annex B quantization routine fails and essentially random codebook indices (which may fall outside of the codebook range) arise which can lead to memory corruption. The following sections list the pertinent Annex B code and the preferred embodiments' adjusted code.

Figure 1:
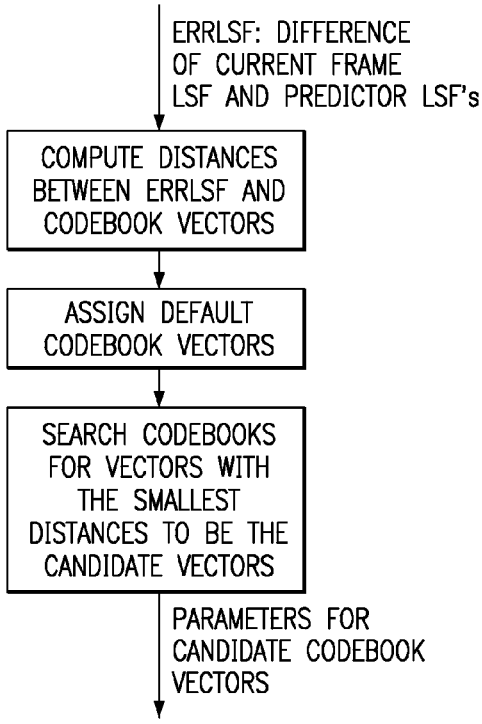
FIGS. 1-2 are flow diagrams for preferred embodiment methods.
Figure 2:
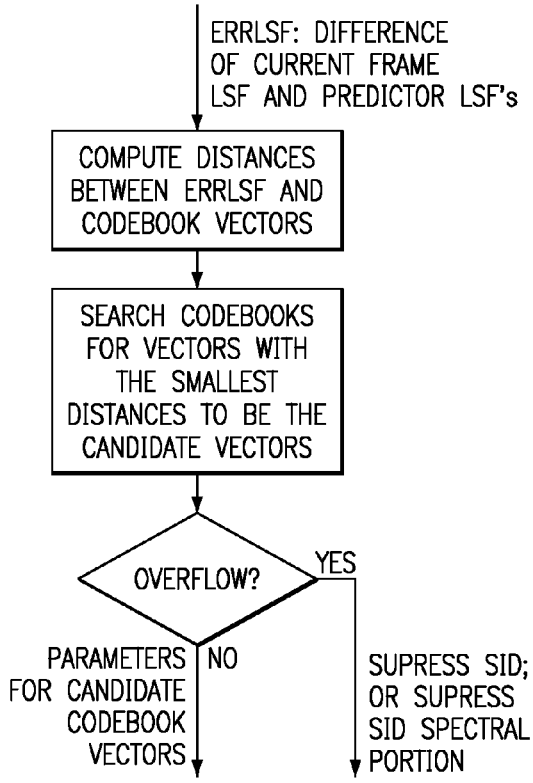
Figure 3:
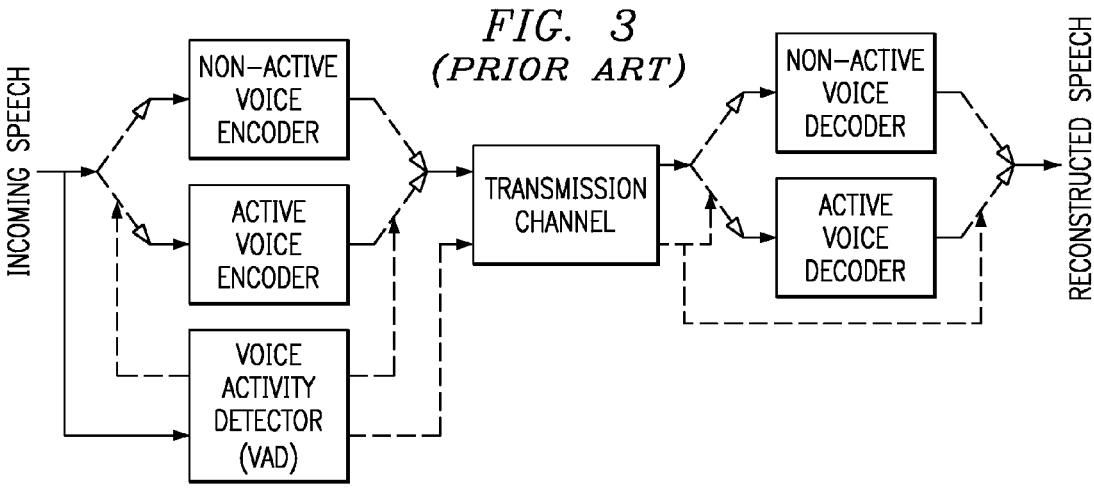
FIG. 3 (PRIOR ART)
FIG. 3 illustrates functional blocks of G.729 Annex B.

FIGS. 1-2 are flow diagrams of portions of preferred embodiments.

The preferred embodiment systems may include digital signal processors (DSPs) or general purpose programmable processors or application specific circuitry or systems on a chip such as both a DSP and RISC processor on the same chip with the RISC processor controller and preferred embodiment encoding and decoding functions as stored programs. Codebooks would be stored in memory at both the encoder and decoder, and a stored program may be in an onboard or external ROM, flash EEPROM, or ferroelectric RAM for a DSP or programmable processor. Analog-to-digital converters and digital-to-analog converters provide coupling to the real world, and modulators and demodulators (plus antennas for air interfaces) provide coupling for transmission waveforms. The encoded speech can be packetized and transmitted over networks such as the Internet.

2. G.729 Annex B Problem

To explain the preferred embodiments, first consider the G.729 Annex B quantization module QsidLSF.c which includes the quantization functions lsfq_noise, Qnt_e, New_ML_search _1, and New_ML_search_2. Basically, Qnt_e employs a two-stage vector quantization with delayed decision quantization in which the first stage outputs a few (typically 4) candidate codebook (quantized) vectors to the second stage and the second stage performs a full quantization. Multiple (typically 2) moving average predictors are used to predict the current frame LSF vector, and the prediction error ("errlsf") is the target vector for the quantization.

The lsfq_noise function takes as input the current (two-frame average) lsp vector plus the prior (four-frame) lsf vectors to generate predictors and output the quantized lsp vector plus codebook and predictor indices. In particular, lsfq_noise calls Qnt_e which, in turn, calls the two codebook search functions New_ML_search_1 and New_ML_search_2 for the two quantizations. As described below, an overflow problem arises in the search functions New_ML_search_1 and New_ML_search_2. Note that "lsf[ ]" is the current (two)-frame lsf vector; "freq_prev[ ][ ]" are the previous frames' lsf vectors used to make the predictors; "errlsf[ ]" is a one-dimensional array of the prediction errors (differences of lsf[ ] and the moving average predictors), so errlsf is the quantization target; and "sum[ ]" is a list of the distances between errlsf and the codebook quantized vectors, so the K minimal entries of sum[ ] should correspond to K quantization candidates.

```
/*-----------------------------------------------------------------*
* Functions lsfq_noise                                              *
*           ~~~~~~~~~~                                              *
* Input:                                                            *
*       lsp[]           : unquantized lsp vector                    *
```

-continued

```
     *          freq_prev[][]     : memory of the lsf predictor          *
     *                                                                   *
     * Output:                                                           *
     *                                                                   *
     *          lspq[]            : quantized lsp vector                 *
     *          ana[]             : indices                              *
     *                                                                   *
     *-------------------------------------------------------------------*/
void lsfq_noise (Word16 *lsp,
                 Word16 *lspq,
                 Word16 freq_prev[MA_NP][M],
                 Word16 *ana
                 )
{
     Word16 i, lsf[M], lsfq[M], weight[M], tmpbuf[M];
     Word16 MS[MODE] = {32, 16}, Clust[MODE], mode, errlsf[M*MODE];
     /* convert lsp to lsf */
     Lsp_lsf2 (lsp, lsf, M);
     /* spacing to ~100Hz */
     if (lsf[0] < L_LIMIT)
          lsf[0] = L_LIMIT;
     for (i=0 ; i < M-1 ; i++)
          if (sub(lsf[i+1], lsf[i]) < 2*GAP3)
               lsf[i+1] = add(lsf[i], 2*GAP3);
     if (lsf[M-1] > M_LIMIT)
          lsf[M-1] = M_LIMIT;
     if (lsf[M-1] < lsf[M-2])
          lsf[M-2] = sub(lsf[M-1], GAP3);
     /* get the lsf weighting */
     Get_wegt(lsf, weight);
     /**********************/
     /* quantize the lsf's */
     /**********************/
     /* get the prediction error vector */
     for (mode=0; mode<MODE; mode++)
          Lsp_prev_extract(lsf, errlsf+mode*M, noise_fg[mode], freq_prev,
                                                  noise_fg_sum_inv[mode]);
     /* quantize the lsf and get the corresponding indices */
     Qnt_e(errlsf, weight, MODE, tmpbuf, &mode, 1, Clust, MS);
     ana[0] = mode;
     ana[1] = Clust[0];
     ana[2] = Clust[1];
     /* guarantee minimum distance of 0.0012 (~10 in Q13) between tmpbuf[j]
          and tmpbuf[j+1] */
     Lsp_expand_1_2(tmpbuf, 10);
     /* compute the quantized lsf vector */
     Lsp_prev_compose(tmpbuf, lsfq, noise_fg[mode], freq_prev,
                                     noise_fg_sum[mode]);
     /* update the prediction memory */
     Lsp_prev_update(tmpbuf, freq_prev);
     /* lsf stability check */
     Lsp_stability(lsfq);
     /* convert lsf to lsp */
     Lsf_lsp2(lsfq, lspq, M);
}
```

The called quantization function Qnt_e ( ) is

```
static void Qnt_e(
                 Word16 *errlsf,      /* (i)     : error lsf vector          */
                 Word16 *weight,      /* (i)     : weighting vector          */
                 Word16 DIn,          /* (i)     : number of input candidates */
                 Word16 *qlsf,        /* (o)     : quantized error lsf vector */
                 Word16 *Pptr,        /* (o)     : predictor index           */
                 Word16 DOut,         /* (i)     : number of quantized vectors */
                 Word16 *cluster,     /* (o)     : quantizer indices         */
                 Word16 *MS           /* (i)     : size of the quantizers    */
)
{
     Word16 d_data[2][R_LSFQ*M], best_indx[2][R_LSFQ];
     Word16 ptr_back[2][R_LSFQ], ptr, i;
     New_ML_search_1(errlsf, DIn, d_data[0], 4, best_indx[0], ptr_back[0],
                     PtrTab_1, MS[0]);
```

-continued

```
    New__ML__search__2(d__data[0], weight, 4, d__data[1], DOut, best__indx[1],
                ptr__back[0], ptr__back[1], PtrTab__2, MS[1]);
    /* backward path for the indices */
    cluster[1] = best__indx[1][0];
    ptr = ptr__back[1][0];
    cluster[0] = best__indx[0][ptr];
    /* this is the pointer to the best predictor */
    *Pptr = ptr__back[0][ptr];
    /* generating the quantized vector */
    Copy(lspcb1[PtrTab__1[cluster[0]]], qlsf, M);
    for (i=0; i<M/2; i++)
        qlsf[i] = add(qlsf[i], lspcb2[PtrTab__2[0][cluster[1]]][i]);
    for (i=M/2; i<M; i++)
        qlsf[i] = add(qlsf[i], lspcb2[PtrTab__2[1][cluster[1]]][i]);
}
```

The called New_ML_search__1 and New_ML_search__2 functions do the two stages of codebook searching. The searches essentially finds K candidate (delayed decision) quantized vectors as the K codebook vectors closest to one of the J "errlsf" component vectors where "errlsf" component vectors are the J errors (differences) of the current lsf vector from J the moving average predictor vectors. The K output pairs min_indx_p[ ]=p and min_indx_m[ ]=m are the errlsf predictor mode and corresponding quantized vector codebook index, respectively, for the candidate quantized vectors.

```
static void New__ML__search__1(
            Word16 *d__data,        /* (i)   : error vector              */
            Word16 J,               /* (i)   : number of input vectors   */
            Word16 *new__d__data,   /* (o)   : output vector             */
            Word16 K,               /* (i)   : number of candidates      */
            Word16 *best__indx,     /* (o)   : best indices              */
            Word16 *ptr__back,      /* (o)   : pointer for backtracking  */
            Word16 *PtrTab,         /* (i)   : quantizer table           */
            Word16 MQ               /* (i)   : size of quantizer         */
)
{
    Word16 tmp, m, l, p, q, sum[R__LSFQ*R__LSFQ];
    Word16 min[R__LSFQ], min__indx__p[R__LSFQ], min__indx__m[R__LSFQ];
    Word32 acc0;
    for (q=0; q<K; q++)
        min[q] = MAX__16;
    /* compute the errors */
    for (p=0; p<J; p++)
        for (m=0; m<MQ; m++){
            acc0 = 0;
            for (l=0; l<M; l++){
                tmp = sub(d__data[p*M+l], lspcb1[PtrTab[m]][l]);
                acc0 = L__mac(acc0, tmp, tmp);
            }
            sum[p*MQ+m] = extract__h(acc0);
            sum[p*MQ+m] = mult(sum[p*MQ+m], Mp[p]);
        }
    /* select the candidates */
    for (q=0; q<K; q++) {
        for (p=0; p<J; p++)
            for (m=0; m<MQ; m++)
                if (sub(sum[p*MQ+m], min[q]) < 0){
                    min[q] = sum[p*MQ+m];
                    min__indx__p[q] = p;
                    min__indx__m[q] = m;
                }
        sum[min__indx__p[q]*MQ+min__indx__m[q]] = MAX__16;
    }
    /* compute the candidates */
    for (q=0; q<K; q++){
        for (l=0; l<M; l++)
            new__d__data[q*M+l] = sub(d__data[min__indx__p[q]*M+l],
                                      lspcb1[PtrTab[min__indx__m[q]]][l]);
        ptr__back[q] = min__indx__p[q];
        best__indx[q] = min__indx__m[q];
    }
}
static void New__ML__search__2(
            Word16 *d__data,        /* (i)   : error vector              */
```

-continued

```
            Word16 *weight,          /* (i)   : weighting vector          */
            Word16 J,                /* (i)   : number of input vectors   */
            Word16 *new__d__data,    /* (o)   : output vector             */
            Word16 K,                /* (i)   : number of candidates      */
            Word16 *best__indx,      /* (o)   : best indices              */
            Word16 *ptr__prd,        /* (i)   : pointer for backtracking  */
            Word16 *ptr__back,       /* (o)   : pointer for backtracking  */
            Word16 PtrTab[2][16],    /* (i)   : quantizer table           */
            Word16 MQ                /* (i)   : size of quantizer         */
)
{
    Word16 m, l, p, q, sum[R__LSFQ*R__LSFQ];
    Word16 min[R__LSFQ], min__indx__p[R__LSFQ], min__indx__m[R__LSFQ];
    Word16 tmp1, tmp2;
    Word32 acc0;
    for (q=0; q<K; q++)
        min[q] = MAX__16;
    /* compute the errors */
    for (p=0; p<J; p++)
        for (m=0; m<MQ; m++){
            acc0 = 0;
            for (l=0; l<M/2; l++){
                tmp1 = extract__h(L__shl(L__mult(noise__fg__sum[ptr__prd[p]][l],
                                    noise__fg__sum[ptr__prd[p]][1]), 2));
                tmp1 = mult(tmp1, weight[1]);
                tmp2 = sub(d__data[p*M+l], lspcb2[PtrTab[0][m]][l]);
                tmp1 = extract__h(L__shl(L__mult(tmp1, tmp2), 3));
                acc0 = L__mac(acc0, tmp1, tmp2);
            }
            for (l=M/2; l<M; l++){
                tmp1 = extract__h(L__shl(L__mult(noise__fg__sum[ptr__prd[p]][l],
                                    noise__fg__sum[ptr__prd[p]][l]), 2));
                tmp1 = mult(tmp1, weight[l]);
                tmp2 = sub(d__data[p*M+l], lspcb2[PtrTab[l][m]][l]);
                tmp1 = extract__h(L__shl(L__mult (tmp1, tmp2), 3));
                acc0 = L__mac(acc0, tmp1, tmp2);
            }
            sum[p*MQ+m] = extract__h(acc0);
        }
    /* select the candidates */
    for (q=0; q<K; q++){
        for (p=0; p<J; p++)
            for (m=0; m<MQ; m++)
                if (sub(sum[p*MQ+m], min[q]) < 0){
                    min[q] = sum[p*MQ+m];
                    min__indx__p[q] = p;
                    min__indx__m[q] = m;
                }
        sum[min__indx__p[q]*MQ+min__indx__m[q]] = MAX__16;
    }
    /* compute the candidates */
    for (q=0; q<K; q++){
        for (l=0; l<M/2; l++)
            new__d__data[q*M+l] = sub(d__data[min__indx__p[q]*M+l],
                                lspcb2[PtrTab[0][min__indx__m[q]]][l]);
            for (l=M/2; l<M; l++)
                new__d__data[q*M+l] = sub(d__data[min__indx__p[q]*M+l],
                                lspcb2[PtrTab[1][min__indx__m[q]]][l]);
        ptr__back[q] = min__indx__p[q];
        best__indx[q] = min__indx__m[q];
    }
}
```

The invention recognizes a problem in the foregoing select candidate routines which have the nested for loops

```
/* select the candidates */
    for (q=0; q<K; q++){
        for (p=0; p<J; p++)
            for (m=0; m<MQ; m++)
                if (sub(sum[p*MQ+m], min[q]} < 0){
                    min[q] = sum[p*MQ+m];
                    min__indx__p[q] = p;
                    min__indx__m[q] = m;
```

-continued

```
                }
        sum[min__indx__p[q]*MQ+min__indx__m[q]] = MAX__16;
    }
```

These nested for loops perform the codebook searches with K the number of candidate codebook quantized vectors, J the number of predictor modes (variable p), MQ the number of quantized vectors in the codebook (variable m), and sum [p*MQ+m] the one-dimensional array of distances between the errlsf vector and the codebook quantized vectors. In particular, the invention recognizes the problem occurring when the errlsf component vectors are not near any of the codebook quantized vectors. In this case sum[p*MQ+m] for all p and m will equal MAX_16 (overflow), so the condition if(sub(sum[p*MQ+m], min[q])<0) will never be true. With the if condition never true, the p and m values will not be assigned and essentially be random. But not all p and m are within allowed ranges, and memory corruption arises. The preferred embodiments fix this problem.

3. First Preferred Embodiment

FIG. 1 is a flow diagram for a first preferred embodiment SID LSF quantization method. In particular, a first preferred embodiment SID LSF quantization provides a limited range (within codebook range) default assignments for the predictor mode and codebook index which eliminates the randomness of the case of overflow.

In particular, first preferred embodiments include default assignments of p and m in the select candidate searches:

```
/* These constant values must be in the specified range for all
 * possible values of J and MQ passed to New_ML_search_1 ( )
 */
#define ML_SEARCH_1_MIN_INDX_P_DEFAULT 0 /* Between 0 and J-1 */
#define ML_SEARCH_1_MIN_INDX_M_DEFAULT 0 /* Between 0 and MQ-1 */
/* These constant values must be in the specified range for all
 * possible values of J and MQ passed to New_ML_search_2 ( )
 */
#define ML_SEARCH_2_MIN_INDX_P_DEFAULT 0 /* Between 0 and J-1 */
#define ML_SEARCH_2_MIN_INDX_M_DEFAULT 0 /* Between 0 and MQ-1 */
static void New_ML_search_1 (
            Word16 *d_data,          /* (i)   : error vector              */
            Word16 J,                /* (i)   : number of input vectors   */
            Word16 *new_d_data,      /* (o)   : output vector             */
            Word16 K,                /* (i)   : number of candidates      */
            Word16 *best_indx,       /* (o)   : best indices              */
            Word16 *ptr_back,        /* (o)   : pointer for backtracking  */
            Word16 *PtrTab,          /* (i)   : quantizer table           */
            Word16 MQ                /* (i)   : size of quantizer         */
)
{
    Word16 tmp, m, l, p, q, sum[R_LSFQ*R_LSFQ];
    Word16 min[R_LSFQ], min_indx_p[R_LSFQ], min_indx_m[R_LSFQ];
    Word32 acc0;
    for (q=0; q<K; q++)
        min[q] = MAX_16;
    /* compute the errors */
    for (p=0; p<J; p++)
        for (m=0; m<MQ; m++){
            acc0 = 0;
            for (l=0; l<M; l++){
                tmp = sub(d_data[p*M+l], lspcb1[PtrTab[m]][1]);
                acc0 = L_mac(acc0, tmp, tmp);
            }
            sum[p*MQ+m] = extract_h(acc0);
            sum[p*MQ+m] = mult(sum[p*MQ+m], Mp[p]);
        }
    /* select the candidates */
    for (q=0; q<K; q++) {
        /* Select constant defaults. If the selection fails,
         * these values will be used to select a codebook entry.
         * If the selection succeeds, it will replace these values
         * with the selected entries.
         */
        min_indx_p[q] = ML_SEARCH_1_MIN_INDX_P_DEFAULT;
        min_indx_m[q] = ML_SEARCH_1_MIN_INDX_M_DEFAULT;
        for (p=0; p<J; p++)
            for (m=0; m<MQ; m++)
                if (sub(sum[p*MQ+m], min[q]) < 0){
                    min[q] = sum[p*MQ+m];
                    min_indx_p[q] = p;
                    min_indx_m[q] = m;
                }
        sum[min_indx_p[q]*MQ+min_indx_m[q]] = MAX_16;
    }
    /* compute the candidates */
    for (q=0; q<K; q++){
        for (l=0; l<M; l++)
            new_d_data[q*M+l] = sub(d_data[min_indx_p[q]*M+l],
                                    lspcb1[PtrTab[min_indx_m[q]]][l]);
```

-continued

```
        ptr_back[q] = min_indx_p[q];
        best_indx[q] = min_indx_m[q];
    }
}
static void New_ML_search_2(
            Word16 *d_data,         /* (i)   : error vector              */
            Word16 *weiqht,         /* (i)   : weighting vector          */
            Word16 J,               /* (i)   : number of input vectors   */
            Word16 *new_d_data,     /* (o)   : output vector             */
            Word16 K,               /* (i)   : number of candidates      */
            Word16 *best_indx,      /* (o)   : best indices              */
            Word16 *ptr_prd,        /* (i)   : pointer for backtracking  */
            Word16 *ptr_back,       /* (o)   : pointer for backtracking  */
            Word16 PtrTab[2][16],   /* (i)   : quantizer table           */
            Word16 MQ               /* (i)   : size of quantizer         */
)
{
    Word16 m, l, p, q, sum[R_LSFQ*R_LSFQ];
    Word16 min[R_LSFQ], min_indx_p[R_LSFQ], min_indx_m[R_LSFQ];
    Word16 tmp1, tmp2;
    Word32 acc0;
    for (q=0; q<K; q++)
        min[q] = MAX_16;
    /* compute the errors */
    for (p=0; p<J; p++)
        for (m=0; m<MQ; m++){
            acc0 = 0;
            for (l=0; l<M/2; l++){
                tmp1 = extract_h(L_shl(L_mult(noise_fg_sum[ptr_prd[p]][l],
                                        noise_fg_sum[ptr_prd[p]][l]), 2));
                tmp1 = mult(tmp1, weight[1]);
                tmp2 = sub(d_data[p*M+l], lspcb2[PtrTab[0][m]][l]);
                tmp1 = extract_h(L_shl(L_mult(tmp1, tmp2), 3));
                acc0 = L_mac(acc0, tmp1, tmp2);
            }
            for (l=M/2; l<M; l++){
                tmp1 = extract_h(L_shl(L_mult(noise_fg_sum[ptr_prd[p]][l],
                                        noise_fg_sum[ptr_prd[p]][l]), 2));
                tmp1 = mult(tmp1, weight[l]);
                tmp2 = sub(d_data[p*M+l], lspcb2[PtrTab[l][m]][l]);
                tmp1 = extract_h(L_shl(L_mult(tmp1, tmp2), 3));
                acc0 = L_mac(acc0, tmp1, tmp2);
            }
            sum[p*MQ+m] = extract_h(acc0);
        }
    /* select the candidates */
    for (q=0; q<K; q++){
        /* Select constant defaults. If the selection fails,
         * these values will be used to select a codebook entry.
         * If the selection succeeds, it will replace these values
         * with the selected entries.
         */
        min_indx_p[q] = ML_SEARCH_2_MIN_INDX_P_DEFAULT;
        min_indx_m[q] = ML_SEARCH_2_MIN_INDX_M_DEFAULT;
        for (p=0; p<J; p++)
            for (m=0; m<MQ; m++)
                if (sub(sum[p*MQ+m], min[q]) < 0){
                    min[q] = sum [p*MQ+m];
                    min_indx_p[q] = p;
                    min_indx_m[q] = m;
                }
        sum[min_indx_p[q]*MQ+min_indx_m[q]] = MAX_16;
    }
    /* compute the candidates */
    for (q=0; q<K; q++){
        for (l=0; l<M/2; l++)
            new_d_data[q*M+l] = sub(d_data[min_indx_p[q]*M+l],
                                    lspcb2[PtrTab[0][min_indx_m[q]]][l]);
        for (l=M/2; l<M; l++)
            new_d_data[q*M+l] = sub(d_data[min_indx_p[q]*M+l],
                                    lspcb2[PtrTab[1][min_indx_m[q]]][l]);
        ptr_back[q] = min_indx_p[q];
        best_indx[q] = min_indx_m[q];
    }
}
```

4. Second Preferred Embodiment Quantization

The second preferred embodiment is analogous to the first preferred embodiment but randomly picks (within the possible range) default values for the assignments of p and m in the overflow case for both search functions. The listing is as follows.

```
static void New_ML_search_1(
            Word16 *d_data,          /* (i)   : error vector              */
            Word16 J,                /* (i)   : number of input vectors   */
            Word16 *new_d_data,      /* (o)   : output vector             */
            Word16 K,                /* (i)   : number of candidates      */
            Word16 *best_indx,       /* (o)   : best indices              */
            Word16 *ptr_back,        /* (o)   : pointer for backtracking  */
            Word16 *PtrTab,          /* (i)   : quantizer table           */
            Word16 MQ                /* (i)   : size of quantizer         */
)
{
    Word16 tmp, m, l, p, q, sum[R_LSFQ*R_LSFQ];
    Word16 min[R_LSFQ], min_indx_p[R_LSFQ], min_indx_m[R_LSFQ];
    Word32 acc0;
    for (q=0; q<K; q++)
        min[q] = MAX_16;
    /* compute the errors */
    for (p=0; p<J; p++)
        for (m=0; m<MQ; m++){
            acc0 = 0;
            for (l=0; l<M; l++){
                tmp = sub(d_data[p*M+l], lspcb1[PtrTab[m]][l]);
                acc0 = L_mac(acc0, tmp, tmp);
            }
            sum[p*MQ+m] = extract_h(acc0);
            sum[p*MQ+m] = mult(sum[p*MQ+m], Mp[p]);
        }
    /* select the candidates */
    for (q=0; q<K; q++) {
        /* Select random defaults. If the selection fails,
         * these values will be used to select a codebook entry.
         * If the selection succeeds, it will replace these values
         * with the selected entries.
         */
        min_indx_p[q] = random (0, J-1); /* Random integer between 0 and J-1,
    inclusive */
        min_indx_m[q] = random (0, MQ-1); /* Random integer between 0 and MQ-
    1, inclusive */
        for (p=0; p<J; p++)
            for (m=0; m<MQ; m++)
                if (sub(sum[p*MQ+m], min[q]) < 0){
                    min[q] = sum [p*MQ+m];
                    min_indx_p[q] = p;
                    min_indx_m[q] = m;
            }
        sum[min_indx_p[q]*MQ+min_indx_m[q]] = MAX_16;
    }
    /* compute the candidates */
    for (q=0; q<K; q++) {
        for (l=0; l<M; l++}
            new_d_data[q*M+l] = sub(d_data[min_indx_p[q]*M+l],
                                    lspcb1[PtrTab[min_indx_m[q]]][l]);
        ptr_back[q] = min_indx_p[q];
        best_indx[q] = min_indx_m[q];
    }
}
static void New_ML_search_2(
            Word16 *d_data,          /* (i)   : error vector              */
            Word16 *weight,          /* (i)   : weighting vector          */
            Word16 J,                /* (i)   : number of input vectors   */
            Word16 *new_d_data,      /* (o)   : output vector             */
            Word16 K,                /* (i)   : number of candidates      */
            Word16 *best_indx,       /* (o)   : best indices              */
            Word16 *ptr_prd,         /* (i)   : pointer for backtracking  */
            Word16 *ptr_back,        /* (o)   : pointer for backtracking  */
            Word16 PtrTab[2][16],    /* (i)   : quantizer table           */
            Word16 MQ                /* (i)   : size of quantizer         */
)
{
    Word16 m, l, p, q, sum[R_LSFQ*R_LSFQ];
    Word16 min[R_LSFQ], min_indx_p[R_LSFQ], min_indx_m[R_LSFQ];
    Word16 tmp1, tmp2;
    Word32 acc0;
    for (q=0; q<K; q++)
```

-continued

```
        min[q] = MAX_16;
    /* compute the errors */
    for (p=0; p<J; p++)
        for (m=0; m<MQ; m++){
            acc0 = 0;
            for (l=0; l<M/2; l++){
                tmp1 = extract_h(L_shl(L_mult(noise_fg_sum[ptr_prd[p]][l],
                                        noise_fg_sum[ptr_prd[p]][l]), 2));
                tmp1 = mult(tmp1, weight[l]);
                tmp2 = sub(d_data[p*M+l], lspcb2[PtrTab[0][m]][l]);
                tmp1 = extract_h(L_shl(L_mult (tmp1, tmp2), 3));
                acc0 = L_mac(acc0, tmp1, tmp2);
            }
            for (l=M/2; l<M; l++){
                tmp1 = extract_h(L_shl(L_mult (noise_fg_sum[ptr_prd[p]][l],
                                        noise_fg_sum[ptr_prd[p]][l]), 2)};
                tmp1 = mult(tmp1, weight[l]);
                tmp2 = sub(d_data[p*M+l], lspcb2[PtrTab[1][m]][l]);
                tmp1 = extract_h(L_shl(L_mult (tmp1, tmp2), 3));
                acc0 = L_mac(acc0, tmp1, tmp2);
            }
            sum[p*MQ+m] = extract_h(acc0);
        }
    /* select the candidates */
    for (q=0; q<K; q++){
        /* Select random defaults. If the selection fails,
         * these values will be used to select a codebook entry.
         * If the selection succeeds, it will replace these values
         * with the selected entries.
         */
        min_indx_p[q] = random (0, J-1); /* Random integer between 0 and J-1,
inclusive */
        min_indx_m[q] = random (0, MQ-1); /* Random integer between 0 and MQ-
1, inclusive */
        for (p=0; p<J; p++)
            for (m=0; m<MQ; m++)
                if (sub(sum[p*MQ+m], min[q]) < 0){
                    min[q] = sum [p*MQ+m];
                    min_indx_p[q] = p;
                    min_indx_m[q] = m;
                }
        sum [min_indx_p[q]*MQ+min_indx_m[q]] = MAX_16;
    }
    /* compute the candidates */
    for (q=0; q<K; q++){
        for (l=0; l<M/2; l++)
            new_d_data[q*M+l] = sub(d_data[min_indx_p[q]*M+l],
                                    lspcb2[PtrTab[0][min_indx_m[q]]][l]);
        for (l=M/2; l<M; l++)
            new_d_data[q*M+l] = sub(d_data[min_indx_p[q]*M+l],
                                    lspcb2[PtrTab[1][min_indx_m[q]]][l]);
        ptr_back[q] = min_indx_p[q];
        best_indx[q] = min_indx_m[q];
    }
}
```

5. Third Preferred Embodiment Quantizations

Third preferred embodiments include an overflow flag to solve the overflow problem of G.729 Annex B; the overflow flag indicates an overflow in either the first or second quantization stage. Upon overflow the third preferred embodiments suppress the generation of the SID frame(s) and the encoder continues to produce the same output as before the overflow; this persists until the overflow condition ends. See FIG. 2. This also includes adjustment of the Annex B module Dtx.c function Cod_cng which generates the transmission; thus the following listings include the preferred embodiment adjusted quantization functions plus the Annex B function Cod_cng and the preferred embodiment adjusted code for Cod_cng:

```
#define OVERFLOW    1
#define NO_OVERFLOW 0
/*-----------------------------------------------------------------*
 * Functions lsfq_noise                                            *
 *           ~~~~~~~~~~                                            *
 * Input:                                                          *
 *       lsp[]              : unquantized lsp vector               *
 *       freq_prev[][]      : memory of the lsf predictor          *
```

-continued

```
*                                                                    *
* Output:                                                            *
*                                                                    *
*        lspq[]              : quantized lsp vector                  *
*        ana[]               : indices                               *
*                                                                    *
*-------------------------------------------------------------------*/
/* Prototype must be changed in all header files */
Word16 lsfq_noise(Word16 *lsp,
            Word16 *lspq,
            Word16 freq_prev[MA_NP][M],
            Word16 *ana
            )
{
    Word16 i, lsf[M], lsfq[M], weight[M], tmpbuf[M];
    Word16 MS[MODE] = {32, 16}, Clust[MODE], mode, errlsf[M*MODE];
    Word16 overflow_flag;
    /* convert lsp to lsf */
    Lsp_lsf2(lsp, lsf, M);
    /* spacing to ~100Hz */
    if (lsf[0] < L_LIMIT)
        lsf[0] = L_LIMIT;
    for (i=0 ; i < M-1 ; i++)
        if (sub(lsf[i+1], lsf[i]) < 2*GAP3)
            lsf[i+1] = add(lsf[i], 2*GAP3);
        if (lsf[M-1] > M_LIMIT)
            lsf[M-1] = M_LIMIT;
        if (lsf[M-1] < lsf[M-2])
            lsf[M-2] = sub(lsf[M-1], GAP3);
        /* get the lsf weighting */
        Get_wegt(lsf, weight);
        /**********************/
        /* quantize the lsf's */
        /**********************/
        /* get the prediction error vector */
        for (mode=0; mode<MODE; mode++)
            Lsp_prev_extract(lsf, errlsf+mode*M, noise_fg[mode], freq_prev,
                                                    noise_fg_sum_inv[mode]);
        /* quantize the lsf and get the corresponding indices */
        overflow_flag = Qnt_e(errlsf, weight, MODE, tmpbuf, &mode, 1, Clust,
    MS);
        if (overflow_flag == OVERFLOW)
            return (overflow_flag);
        ana[0] = mode;
        ana[1] = Clust[0];
        ana[2] = Clust[1];
        /* guarantee minimum distance of 0.0012 (~10 in Q13) between tmpbuf[j]
            and tmpbuf[j+1] */
        Lsp_expand_1_2(tmpbuf, 10);
        /* compute the quantized lsf vector */
        Lsp_prev_compose(tmpbuf, lsfq, noise_fg[mode], freq_prev,
                                                    noise_fg_sum[mode]);
        /* update the prediction memory */
        Lsp_prev_update (tmpbuf, freq_prev);
        /* lsf stability check */
        Lsp_stability(lsfq);
        /* convert lsf to lsp */
        Lsf_lsp2(lsfq, lspq, M);
}
static Word16 Qnt_e(
            Word16 *errlsf,         /* (i)    : error lsf vector          */
            Word16 *weight,         /* (i)    : weighting vector          */
            Word16 DIn,             /* (i)    : number of input candidates */
            Word16 *qlsf,           /* (o)    : quantized error lsf vector */
            Word16 *Pptr,           /* (o)    : predictor index           */
            Word16 DOut,            /* (i)    : number of quantized vectors */
            Word16 *cluster,        /* (o)    : quantizer indices         */
            Word16 *MS              /* (i)    : size of the quantizers    */
)
{
    Word16 d_data[2][R_LSFQ*M], best_indx[2][R_LSFQ];
    Word16 ptr_back[2][R_LSFQ], ptr, i;
    Word16 overflow_flag;
    overflow_flag = New_ML_search_1(errlsf, DIn, d_data[0], 4, best_indx[0],
ptr_back[0]
                PtrTab_1, MS[0]);
    if (overflow_flag == OVERFLOW) return overflow_flag;
    overflow_flag = New_ML_search_2(d_data[0], weight, 4, d_data[1], DOut,
best_indx[1],
```

-continued

```
                    ptr_back[0], ptr_back[1], PtrTab_2, MS[1]);
    if (overflow_flag == OVERFLOW) return overflow_flag;
    /* backward path for the indices */
    cluster[1] = best_indx[1][0];
    ptr = ptr_back[1][0];
    cluster[0] = best_indx[0][ptr];
    /* this is the pointer to the best predictor */
    *Pptr = ptr_back[0][ptr];
    /* generating the quantized vector */
    Copy(lspcb1[PtrTab_1[cluster[0]]], qlsf, M);
    for (i=0; i<M/2; i++)
        qlsf[i] = add(qlsf[i], lspcb2[PtrTab_2[0][cluster[1]]][i]);
    for (i=M/2; i<M; i++)
        qlsf[i] = add(qlsf[i], lspcb2[PtrTab_2[1][cluster[1]]][i]);
    return NO_OVERFLOW;
}
static Word16 New_ML_search_1(
            Word16 *d_data,         /* (i)   : error vector              */
            Word16 J,               /* (i)   : number of input vectors   */
            Word16 *new_d_data,     /* (o)   : output vector             */
            Word16 K,               /* (i)   : number of candidates      */
            Word16 *best_indx,      /* (o)   : best indices              */
            Word16 *ptr_back,       /* (o)   : pointer for backtracking  */
            Word16 *PtrTab,         /* (i)   : quantizer table           */
            Word16 MQ               /* (i)   : size of quantizer         */
)
{
    Word16 tmp, m, l, p, q, sum[R_LSFQ*R_LSFQ];
    Word16 min[R_LSFQ], min_indx_p[R_LSFQ], min_indx_m[R_LSFQ];
    Word32 acc0;
    Word16 overflow_flag;
    for (q=0; q<K; q++)
        min[q] = MAX_16;
    /* compute the errors */
    for (p=0; p<J; p++)
        for (m=0; m<MQ; m++){
            acc0 = 0;
            for (l=0; l<M; l++){
                tmp = sub(d_data[p*M+l], lspcb1[PtrTab[m]][l]);
                acc0 = L_mac(acc0, tmp, tmp);
            }
            sum[p*MQ+m] = extract_h(acc0);
            sum[p*MQ+m] = mult(sum[p*MQ+m], Mp[p]);
        }
    /* select the candidates */
    for (q=0; q<K; q++){
        overflow_flag = OVERFLOW;
        for (p=0; p<J; p++)
            for (m=0; m<MQ; m++)
                if (sub(sum[p*MQ+m], min[q]) < 0){
                    min[q] = sum[p*MQ+m];
                    min_indx_p[q] = p;
                    min_indx_m[q] = m;
                    overflow_flag = NO_OVERFLOW;
                }
        if (overflow_flag == OVERFLOW)
            return overflow_flag;
        sum [min_indx_p[q]*MQ+min_indx_m[q]] = MAX_16;
    }
    /* compute the candidates */
    for (q=0; q<K; q++){
        for (l=0; l<M; l++)
            new_d_data[q*M+l] = sub(d_data[min_indx_p[q]*M+l],
                                    lspcb1[PtrTab[min_indx_m[q]]][l]);
        ptr_back[q] = min_indx_p[q];
        best_indx[q] = min_indx_m[q];
    }
    return NO_OVERFLOW;
}
static Word16 New_ML_search_2(
            Word16 *d_data,         /* (i)   : error vector              */
            Word16 *weight,         /* (i)   : weighting vector          */
            Word16 J,               /* (i)   : number of input vectors   */
            Word16 *new_d_data,     /* (o)   : output vector             */
            Word16 K,               /* (i)   : number of candidates      */
            Word16 *best_indx,      /* (o)   : best indices              */
            Word16 *ptr_prd,        /* (i)   : pointer for backtracking  */
            Word16 *ptr_back,       /* (o)   : pointer for backtracking  */
            Word16 PtrTab[2][16],   /* (i)   : quantizer table           */
```

-continued

```
            Word16 MQ                    /* (i)     : size of quantizer                    */
)
{
    Word16 m, l, p, q, sum[R_LSFQ*R_LSFQ];
    Word16 min[R_LSFQ], min_indx_p[R_LSFQ], min_indx_m[R_LSFQ];
    Word16 tmp1, tmp2;
    Word32 acc0;
    Word16 overflow_flag;
    for (q=0; q<K; q++)
    min[q] = MAX_16;
    /* compute the errors */
    for (p=0; p<J; p++)
        for (m=0; m<MQ; m++){
            acc0 = 0;
            for (l=0; l<M/2; l++){
                tmp1 = extract_h(L_shl(L_mult (noise_fg_sum[ptr_prd[p]][l],
                                                noise_fg_sum[ptr_prd[p]][l]),2));
                tmp1 = mult(tmp1, weight[l]);
                tmp2 = sub(d_data[p*M+l], lspcb2[PtrTab[0][m]][l]);
                tmp1 = extract_h(L_shl(L_mult(tmp1, tmp2), 3));
                acc0 = L_mac(acc0, tmp1, tmp2);
            }
            for (l=M/2; l<M; l++){
                tmp1 = extract_h(L_shl(L_mult (noise_fg_sum[ptr_prd[p]][l],
                                                noise_fg_sum[ptr_prd[p]][l]), 2));
                tmp1 = mult(tmp1, weight[l]};
                tmp2 = sub(d_data[p*M+l], lspcb2[PtrTab[l][m]][l]);
                tmp1 = extract_h(L_shl(L_mult(tmp1, tmp2), 3));
                acc0 = L_mac(acc0, tmp1, tmp2 );
            }
            sum[p*MQ+m] = extract_h(acc0);
        }
    /* select the candidates */
    for (q=0; q<K; q++){
        overflow_flag = OVERFLOW;
        for (p=0; p<J; p++)
            for (m=0; m<MQ; m++)
                if (sub(sum[p*MQ+m], min[q]) < 0){
                    min[q] = sum[p*MQ+m];
                    min_indx_p[q] = p;
                    min_indx_m[q] = m;
                    overflow_flag = NO_OVERFLOW;
                }
        if (overflow_flag == OVERFLOW)
            return overflow_flag;
        sum[min_indx_p[q]*MQ+min_indx_m[q]] = MAX_16;
    }
    /* compute the candidates */
    for (q=0; q<K; q++){
        for (l=0; l<M/2; l++)
            new_d_data[q*M+l] = sub(d_data[min_indx_p[q]*M+l],
                                    lspcb2[PtrTab[0][min_indx_m[q]]][l]);
        for (l=M/2; l<M; l++)
            new_d_data[q*M+l] = sub(d_data[min_indx_p[q]*M+l],
                                    lspcb2[PtrTab[1][min_indx_m[q]]][l]);
        ptr_back[q] = min_indx_p[q];
        best_indx[q] = min_indx_m[q];
    }
    return NO_OVERFLOW;
}
```

The Annex B module Dtx.c function Cod_cng computes DTX (discontinuous transmission), encodes SID (silence indicator descriptor) frames, and computes CNG (comfort noise generator) excitation update:

```
void Cod_cng(
    Word16 *exc,                  /* (i/o)   : excitation array                     */
    Word16 pastVad,               /* (i)     : previous VAD decision                */
    Word16 *lsp_old_q,            /* (i/o)   : previous quantized lsp               */
    Word16 *Aq,                   /* (o)     : set of interpolated LPC coefficients */
    Word16 *ana,                  /* (o)     : coded SID parameters                 */
    Word16 freq_prev[MA_NP][M],   /* (i/o)   : previous LPS for quantization        */
    Word16 *seed                  /* (i/o)   : random generator seed                */
)
```

-continued

```
{
    Word16 i;
    Word16 curAcf[MP1];
    Word16 bid[M], zero[MP1];
    Word16 curCoeff[MP1];
    Word16 lsp__new[M];
    Word16 *lpcCoeff;
    Word16 cur__igain;
    Word16 energyq, temp;
    Word16 overflow__flag = NO__OVERFLOW;
    /* Update Ener and sh__ener */
    for(i = NB__GAIN-1; i>=1; i--) {
        ener[i] = ener[i-1];
        sh__ener[i] = sh__ener[i-1];
    }
    /* Compute current Acfs */
    Calc__sum__acf(Acf, sh__Acf, curAcf, &sh__ener[0], NB__CURACF);
    /* Compute LPC coefficients and residual energy */
    if(curAcf[0] == 0) {
        ener[0] = 0;            /* should not happen */
    }
    else {
        Set__zero(zero, MP1);
        Levinson(curAcf, zero, curCoeff, bid, &ener[0]);
    }
    /* if first frame of silence => SID frame */
    if(pastVad != 0) {
        ana[0] = 2;
        count__fr0 = 0;
        nb__ener = 1;
    Qua__Sidgain(ener, sh__ener, nb__ener, &energyq, &cur__igain);
}
else {
    nb__ener = add(nb__ener, 1);
    if(sub(nb__ener, NB__GAIN) > 0) nb__ener = NB__GAIN;
    Qua__Sidgain(ener, sh__ener, nb__ener, &energyq, &cur__igain);
    /* Compute stationarity of current filter */
    /* versus reference filter                */
    if(Cmp__filt(RCoeff, sh__RCoeff, curAcf, ener[0], FRAC__THRESH1) != 0) {
        flag__chang = 1;
    }
    /* compare energy difference between current frame and last frame */
    temp = abs__s(sub(prev energy, energyq));
    temp = sub(temp, 2);
    if (temp > 0) flag__chang = 1;
    count__fr0 = add(count__fr0, 1);
    if(sub(count__fr0, FR__SID__MIN) < 0) {
        ana[0] = 0;                 /* no transmission */
    }
    else {
        if(flag__chang != 0) {
            ana[0] = 2;             /* transmit SID frame */
        }
        else{
            ana[0] = 0;
        }
        count__fr0 = FR__SID__MIN; /* to avoid overflow */
    }
}
if(sub(ana[0], 2) == 0) {
    /* Reset frame count and change flag */
    count__fr0 = 0;
    flag__chang = 0;
    /* Compute past average filter          */
    Calc__pastfilt(pastCoeff);
    Calc__RCoeff(pastCoeff, RCoeff, &sh__RCoeff);
    /* Compute stationarity of current filter */
    /* versus past average filter             */
    /* if stationary */
    /* transmit average filter => new ref. filter */
    if(Cmp__filt(RCoeff, sh__RCoeff, curAcf, ener[0], FRAC__THRESH2) == 0) {
        lpcCoeff = pastCoeff;
    }
    /* else */
    /* transmit current filter => new ref. filter */
    else {
        lpcCoeff = curCoeff;
        Calc__RCoeff(curCoeff, RCoeff, &sh__RCoeff);
    }
```

-continued

```
    /* Compute SID frame codes */
    Az_lsp(lpcCoeff, lsp_new, lsp_old_q); /* From A(z) to lsp */
    /* LSP quantization */
    lsfq_noise(lsp_new, lspSid_q, freq_prev, &ana[l]);
prev_energy = energyq;
        ana[4] = cur_igain;
        sid_gain = tab_Sidgain[cur_igain];
    } /* end of SID frame case */
    if(pastVad != 0) {
        cur_gain = sid_gain;
    }
    else {
        cur_gain = mult_r(cur_gain, A_GAIN0);
        cur_gain = add(cur_gain, mult_r(sid_gain, A_GAIN1));
    }
Calc_exc_rand(cur_gain, exc, seed, FLAG_COD);
        Int_qlpc(lsp_old_q, lspSid_q, Aq);
        for(i=0; i<M; i++) {
            lsp_old_q[i]        = lspSid_q[i];
        }
        /* Update sumAcf if fr_cur = 0 */
        if(fr_cur == 0) {
            Update sumAcf( );
        }
    return;
}
```

The preferred embodiment adjusted version of Cod_cng plus some needed definitions:

```
Static Word16 previous_sid_data[PREVIOUS_SID_SIZE];
#define OVERFLOW        1
#define NO_OVERFLOW     0
Void Cod_cng(
    Word16 *exc,                    /* (i/o)  : excitation array                    */
    Word16 pastVad,                 /* (i)    : previous VAD decision               */
    Word16 *lsp_old_q,              /* (i/o)  : previous quantized lsp              */
    Word16 *Aq,                     /* (o)    : set of interpolated LPC coefficients */
    Word16 *ana,                    /* (o)    : coded SID parameters                */
    Word16 freq_prev[MA_NP][M],     /* (i/o)  : previous LPS for quantinzation      */
    Word16 *seed                    /* (i/o)  : random generator seed               */
)
{
    Word16 i;
    Word16 curAcf[MP1];
    Word16 bid[M], zero[MP1];
    Word16 curCoeff[MP1];
    Word16 lsp_new[M];
    Word16 *lpcCoeff;
    Word16 cur_igain;
    Word16 energyq, temp;
    Word16 overflow_flag = NO_OVERFLOW;
    /* Update Ener and sh_ener */
    for(i = NB_GAIN-1; i>=1; i--) {
        ener[i] = ener[i-1];
        sh_ener[i] = sh_ener[i-1];
    }
    /* Compute current Acfs */
    Calc_sum_acf(Acf, sh_Acf, curAcf, &sh_ener[0], NB_CURACF);
    /* Compute LPC coefficients and residual energy */
    if(curAcf[0] == 0) {
        ener[0] = 0;            /* should not happen */
    }
    else {
        Set_zero(zero, MP1);
        Levinson(curAcf, zero, curCoeff, bid, &ener[0]);
    }
    /* if first frame of silence => SID frame */
    if(pastVad != 0) {
        ana[0] = 2;
        count_fr0 = 0;
        nb_ener = 1;
        Qua_Sidgain (ener, sh_ener, nb_ener, &energyq, &cur_igain);
```

-continued

```
}
else {
    nb_ener = add(nb_ener, 1);
    if(sub(nb_ener, NB_GAIN) > 0) nb_ener = NB_GAIN;
    Qua_Sidgain(ener, sh_ener, nb_ener, &energyq, &cur_igain);
    /* Compute stationarity of current filter */
    /* versus reference filter                */
    if(Cmp_filt(RCoeff, sh_RCoeff, curAcf, ener[0], FRAC_THRESH1) != 0) {
        flag_chang = 1;
    }
    /* compare energy difference between current frame and last frame */
    temp = abs_s(sub(prev_energy, energyq));
    temp = sub(temp, 2);
    if(temp > 0) flag_chang = 1;
    count_fr0 = add (count_fr0, 1);
    if(sub(count_fr0, FR_SID_MIN) < 0) {
        ana[0] = 0;                /* no transmission */
    }
    else {
        if (flag_chang != 0) {
            ana[0] = 2;            /* transmit SID frame */
        }
        else{
            ana[0] = 0;
        }
        count_fr0 = FR_SID_MIN; /* to avoid overflow */
    }
}
if(sub(ana[0], 2) == 0) {
    /* Copy lspSid_q, lsp_old_q, and Aq data arrays to the
     * temporary buffer previous_sid_data. The function
     * save_sid_memory is not provided.
     */
    save_sid_memory (previous_sid_data, lspSid_q, lsp_old_q, Aq);
    /* Reset frame count and change flag */
    count_fr0 = 0;
    flag_chang = 0;
    /* Compute past average filter */
    Calc_pastfilt(pastCoeff);
    Calc_RCoeff(pastCoeff, RCoeff, &sh_RCoeff);
    /* Compute stationarity of current filter */
    /* versus past average filter             */
    /* if stationary */
    /* transmit average filter => new ref. filter */
    if(Cmp_filt(RCoeff, sh_RCoeff, curAcf, ener[0], FRAC_THRESH2 ) == 0) {
        lpcCoeff = pastCoeff;
    }
    /* else */
    /* transmit current filter => new ref. filter */
    else {
        lpcCoeff = curCoeff;
        Calc_RCoeff(curCoeff, RCoeff, &sh_RCoeff);
    }
    /* Compute SID frame codes */
    Az_lsp(lpcCoeff, lsp_new, lsp_old_q); /* From A(z) to lsp */
    /* LSP quantization */
    overflow flag = lsfq_noise(lsp_new, lspSid_q, freq_prev, &ana[1]);
    /* undo all the changes for current SID frame, then change
        current frame as noise */
    if (overflow_flag == OVERFLOW){
        ana[0] = 0;
    }
    else {
        prev_energy = energyq;
        ana[4] = cur_igain;
        sid_gain = tab_Sidgain[cur_igain];
    }
} /* end of SID frame case */
if(pastVad != 0 & ana[0]!=0) {
    cur_gain = sid_gain;
}
else {
    cur_gain = mult_r(cur_gain, A_GAIN0);
    cur_gain = add(cur_gain, mult_r(sid_gain, A_GAIN1));
}
if (overflow_flag == NO_OVERFLOW) {
    Calc_exc_rand(cur_gain, exc, seed, FLAG_COD);
    Int_qlpc(lsp_old_q, lspSid_q, Aq);
    for(i=0; i<M; i++) {
```

-continued

```
            lsp__old__q[i]   = lspSid__q[i];
        }
        /* Update sumAcf if fr__cur = 0 */
        if(fr__cur == 0) {
            Update__sumAcf( );
        }
    } else {
        /* Copy saved values of lspSid__q, lsp__old__q, and Aq data arrays from
         * the temporary buffer previous sid__data. The function
         * restore__sid__memory is not provided.
         */
        restore__sid__memory (previous__sid__data, lspSid__q, lsp__old__q, Aq);
    }
    return;
}
```

6. Fourth Preferred Embodiment

Fourth preferred embodiments also use an overflow indication. But rather than suppressing the SID frames at overflow as with the third preferred embodiments, the fourth preferred embodiments only suppress the spectral portion (LSF's) of SID frames at overflow. The fourth preferred embodiments still produce the SID frame amplitude portion; and for such SID frames the spectral portion can be filled in with previous values (or, alternatively, computed some other way); see FIG. 2. Thus the output of the decoder for such SID frames will track the level of the input but not the spectrum. This should provide an improvement over the third preferred embodiments.

Listings of the quantization functions highlight the preferred embodiment adjustments:

```
/* Memory for previous SID characteristics */
static Word16 prev__ana[3];
#define OVERFLOW        1
#define NO__OVERFLOW    0
/*-----------------------------------------------------------------------*
 * Functions lsfq__noise                                                 *
 *          ~~~~~~~~~~                                                   *
 *Input:                                                                 *
 *          lsp[]              : unquantized lsp vector                 *
 *          freq__prev[][]     : memory of the lsf predictor            *
 *                                                                       *
 * Output :                                                              *
 *                                                                       *
 *          lspq[]             : quantized lsp vector                   *
 *          ana[]              : indices                                *
 *                                                                       *
 *-----------------------------------------------------------------------*/
void lsfq__noise(Word16 *lsp,
                 Word16 *lspq,
                 Word16 freq__prev[MA__NP][M],
                 Word16 *ana
                 )
{
    Word16 i, lsf[M], lsfq[M], weight[M], tmpbuf[M];
    Word16 MS[MODE] = {32, 16}, Clust[MODE], mode, errlsf[M*MODE];
    Word16 overflow__flag;
    /* convert lsp to lsf */
    Lsp__lsf2 (lsp, lsf, M);
    /* spacing to ~100Hz */
    if (lsf[0] < L__LIMIT)
        lsf[0] = L__LIMIT;
    for (i=0; i < M-1; i++)
        if (sub(lsf[i+1], lsf[i]) < 2*GAP3)
            lsf[i+1] = add(lsf[i], 2*GAP3);
    if (lsf[M-1] > M__LIMIT)
        lsf[M-1] = M__LIMIT;
    if (lsf[M-1] < lsf[M-2])
        lsf[M-2] = sub(lsf[M-1], GAP3);
    /* get the lsf weighting */
    Get__wegt(lsf, weight);
    /**********************/
    /* quantize the lsf's */
    /**********************/
    /* get the prediction error vector */
    for (mode=0; mode<MODE; mode++)
        Lsp__prev__extract(lsf, errlsf+mode*M, noise__fg[mode], freq__prev,
                                                noise__fg__sum__inv[mode]);
```

-continued

```
    /* quantize the lsf and get the corresponding indices */
    overflow_flag = Qnt_e(errlsf, weight, MODE, tmpbuf, &mode, 1, Clust,
MS);
    if (overflow_flag == OVERFLOW)
        ana[0] = prev_ana[0];
        ana[1] = prev_ana[1];
        ana[2] = prev_ana[2];
        /* backward path for the indices */
        mode   = ana[0];
        cluster[1] = ana[2];
        cluster[0] = ana[1];
        /* generating the quantized vector */
        Copy(lspcb1[PtrTab_1[cluster[0]]], tmpbuf, M);
        for (i=0; i<M/2; i++)
            tmpbuf[i] = add(tmpbuf[i], lspcb2[PtrTab_2[0][cluster[1]]][i]);
        for (i=M/2; i<M; i++)
            tmpbuf[i] = add(tmpbuf[i], lspcb2[PtrTab_2[1][cluster[1]]][i]);
    } else {
        prev_ana[0] = ana[0] = mode;
        prev_ana[1] = ana[1] = Clust[0];
        prev_ana[2] = ana[2] = Clust[1];
    }
    /* guarantee minimum distance of 0.0012 (~10 in Q13) between tmpbuf[j]
        and tmpbuf[j+1] */
    Lsp_expand_1_2(tmpbuf, 10);
    /* compute the quantized lsf vector */
    Lsp_prev_compose(tmpbuf, lsfq, noise_fg[mode], freq_prev,
                                                    noise_fg_sum[mode]);
    /* update the prediction memory */
    Lsp_prev_update(tmpbuf, freq_prev);
    /* lsf stability check */
    Lsp_stability (lsfq);
    /* convert lsf to lsp */
    Lsf_lsp2(lsfq, lspq, M);
}
static Word16 Qnt_e (
            Word16 *errlsf,         /* (i)   : error lsf vector              */
            Word16 *weight,         /* (i)   : weighting vector              */
            Word16 DIn,             /* (i)   : number of input candidates    */
            Word16 *qlsf,           /* (o)   : quantized error lsf vector    */
            Word16 *Pptr,           /* (o)   : predictor index               */
            Word16 DOut,            /* (i)   : number of quantized vectors   */
            Word16 *cluster,        /* (o)   : quantizer indices             */
            Word16 *MS              /* (i)   : size of the quantizers        */
)
{
    Word16 d_data[2][R_LSFQ*M], best_indx[2][R_LSFQ];
    Word16 ptr_back[2][R_LSFQ], ptr, i;
    Word16 overflow_flag;
    overflow_flag = New_ML_search_1 (errlsf, DIn, d_data[0], 4, best_indx[0],
ptr_back[0],
                PtrTab_1, MS[0]);
    if (overflow_flag == OVERFLOW) return overflow_flag;
    overflow_flag = New_ML_search_2(d_data[0], weight, 4, d_data[1], DOut,
best_indx[1],
                ptr_back[0], ptr_back[1], PtrTab_2, MS[1]);
    if (overflow_flag == OVERFLOW) return overflow_flag;
    /* backward path for the indices */
    cluster[1] = best_indx[1][0];
    ptr = ptr_back[1][0];
    cluster[0] = best_indx[0][ptr];
    /* this is the pointer to the best predictor */
    *Pptr = ptr_back[0][ptr];
    /* generating the quantized vector */
    Copy(lspcb1[PtrTab_1[cluster[0]]], qlsf, M);
    for (i=0; i<M/2; i++)
      qlsf[i] = add(qlsf[i], lspcb2[PtrTab_2[0][cluster[1]]][i]);
    for (i=M/2; i<M; i++)
      qlsf[i] = add(qlsf[i], lspcb2[PtrTab_2[1][cluster[1]]][i]);
    return NO_OVERFLOW;
}
static Word16 New_ML_search_1(
            Word16 *d_data,         /* (i)   : error vector                  */
            Word16 J,               /* (i)   : number of input vectors       */
            Word16 *new_d_data,     /* (o)   : output vector                 */
            Word16 K,               /* (i)   : number of candidates          */
            Word16 *best_indx,      /* (o)   : best indices                  */
            Word16 *ptr_back,       /* (o)   : pointer for backtracking      */
            Word16 *PtrTab,         /* (i)   : quantizer table               */
```

-continued

```
            Word16 MQ                /* (i)    : size of quantizer                 */
)
{
    Word16 tmp, m, l, p, q, sum[R_LSFQ*R_LSFQ];
    Word16 min[R_LSFQ], min_indx_p[R_LSFQ], min_indx_m[R_LSFQ];
    Word32 acc0;
    Word16 overflow_flag;
    for (q=0; q<K; q++)
        min[q] = MAX_16;
    /* compute the errors */
    for (p=0; p<J; p++)
        for (m=0; m<MQ; m++){
            acc0 = 0;
            for (l=0; l<M; l++){
                tmp = sub(d_data[p*M+l], lspcb1[PtrTab[m]][l]);
                acc0 = L_mac(acc0, tmp, tmp);
            }
            sum[p*MQ+m] = extract_h(acc0);
            sum[p*MQ+m] = mult(sum[p*MQ+m], Mp[p]);
        }
    /* select the candidates */
    for (q=0; q<K; q++){
        overflow_flag = OVERFLOW;
        for (p=0; p<J; p++)
            for (m=0; m<MQ; m++)
                if (sub(sum[p*MQ+m], min[q]) < 0){
                    min[q] = sum [p*MQ+m];
                    min_indx_p[q] = p;
                    min_indx_m[q] = m;
                    overflow_flag = NO_OVERFLOW;
                }
        if(overflow_flag == OVERFLOW)
            return overflow_flag;
        sum[min_indx_p[q]*MQ+min_indx_m[q]] = MAX_16;
    }
    /* compute the candidates */
    for (q=0; q<K; q++){
        for (l=0; l<M; l++)
            new_d_data[q*M+l] = sub(d_data[min_indx_p[q]*M+l],
                                    lspcb1[PtrTab[min_indx_m[q]]][l]);
        ptr_back[q] = min_indx_p[q];
        best_indx[q] = min_indx_m[q];
    }
    return NO_OVERFLOW;
}
static Word16 New_ML_search_2(
            Word16 *d_data,          /* (i)    : error vector                      */
            Word16 *weight,          /* (i)    : weighting vector                  */
            Word16 J,                /* (i)    : number of input vectors           */
            Word16 *new_d_data,      /* (o)    : output vector                     */
            Word16 K,                /* (i)    : number of candidates              */
            Word16 *best_indx,       /* (o)    : best indices                      */
            Word16 *ptr_prd,         /* (i)    : pointer for backtracking          */
            Word16 *ptr_back,        /* (o)    : pointer for backtracking          */
            Word16 PtrTab[2][16],    /* (i)    : quantizer table                   */
            Word16 MQ                /* (i)    : size of quantizer                 */
)
{
    Word16 m, l, p, q, sum[R_LSFQ*R_LSFQ];
    Word16 min[R_LSFQ], min_indx_p[R_LSFQ], min_indx_m[R_LSFQ];
    Word16 tmp1, tmp2;
    Word32 acc0;
    Word16 overflow_flag;
    for (q=0; q<K; q++)
        min[q] = MAX_16;
    /* compute the errors */
    for (p=0; p<J; p++)
        for (m=0; m<MQ; m++){
            acc0 = 0;
            for (l=0; l<M/2; l++){
                tmp1 = extract_h(L_shl(L_mult(noise_fg_sum[ptr_prd[p]][l],
                                              noise_fg_sum[ptr_prd[p]][l]), 2));
                tmp1 = mult(tmp1, weight[l]);
                tmp2 = sub(d_data[p*M+l], lspcb2[PtrTab[0][m]][l]);
                tmp1 = extract_h(L_shl(L_mult(tmp1, tmp2), 3));
                acc0 = L_mac(acc0, tmp1, tmp2);
            }
            for (l=M/2; l<M; l++){
                tmp1 = extract_h(L_shl(L_mult(noise_fg_sum[ptr_prd[p]][l],
```

-continued

```
                                        noise_fg_sum[ptr_prd[p]][l]), 2));
                tmp1 = mult(tmp1, weight[l]);
                tmp2 = sub(d_data[p*M+l], lspcb2[PtrTab[1][m]][l]};
                tmp1 = extract_h(L_shl(L_mult(tmp1, tmp2), 3));
                acc0 = L_mac(acc0, tmp1, tmp2);
            }
            sum[p*MQ+m] = extract_h(acc0);
        }
    /* select the candidates */
    for (q=0; q<K; q++){
        overflow_flag = OVERFLOW;
        for (p=0; p<J; p++)
            for (m=0; m<MQ; m++)
                if (sub(sum[p*MQ+m], min[q]) < 0){
                    min[q] = sum[p*MQ+m];
                    min_indx_p[q] = p;
                    min_indx_m[q] = m;
                    overflow_flag = NO_OVERFLOW;
                }
        if (overflow_flag == OVERFLOW)
            return overflow_flag;
        sum[min_indx_p[q]*MQ+min_indx_m[q]] = MAX_16;
    }
    /* compute the candidates */
    for (q=0; q<K; q++){
        for (l=0; l<M/2; l++)
            new_d_data[q*M+l] = sub(d_data[min_indx_p[q]*M+l],
                                    lspcb2[PtrTab[0][min_indx_m[q]]][l]);
        for (l=M/2; l<M; l++)
            new_d_data[q*M+l] = sub(d_data[min_indx_p[q]*M+l],
                                    lspcb2[PtrTab[1][min_indx_m[q]]][l]);
        ptr_back[q] = min_indx_p[q];
        best_indx[q] = min_indx_m[q];
    }
    return NO_OVERFLOW;
}
```

7. Fifth Preferred Embodiments

The fifth preferred embodiments also use an overflow indicator plus memory to store parameters of a prior SID frame plus modifications of the quantization and search functions. With an overflow flagged, the encoder simply repeats the prior (stored) SID frame parameters for transmission, and the decoder updates essentially only by the filter interpolation. The preferred embodiment quantization and Cod_cng functions partial listings to highlight changes are:

```
/* Memory for previous SID characteristics */
static Word16 prev_ana [3];
#define OVERFLOW 1
#define NO_OVERFLOW 0
/* Prototype must be changed in all header files */
Word16 lsfq_noise (Word16 *lsp,
                   Word16 *lspq,
                   Word16 freq_prev [MA_NP][M],
                   Word16 *ana
    )
{
    Word16 i, lsf[M], lsfq[M], weight[M], tmpbuf[M];
    Word16 MS[MODE]={32, 16}, Clust[MODE], mode, errlsf[M*MODE];
    Word16 overflow_flag;
    /* convert lsp to lsf */
    /* spacing to ~100Hz */
    /* get the lsf weighting */
    /**********************/
    /* quantize the lsf's */
    /**********************/
    /* get the prediction error vector */
    /* quantize the lsf and get the corresponding indices */
    overflow_flag = Qnt_e(errlsf, weight, MODE, tmpbuf, &mode, 1, Clust,
MS) ;
    if (overflow_flag == OVERFLOW)
        ana[0] = prev_ana[0];
        ana[1] = prev_ana[1];
        ana[2] = prev_ana[2];
        /* backward path for the indices */
```

-continued

```
        mode   = ana[0];
        cluster[1] = ana[2];
        cluster[0] = ana[1];
        /* generating the quantized vector */
        Copy (lspcb1[PtrTab_1[cluster[0]]], tmpbuf, M);
        for (i=0; i<M/2; i++)
            tmpbuf [i] = add(tmpbuf[i], lspcb2[PtrTab_2[0][cluster[1]]][i]);
        for (i=M/2; i<M; i++)
            tmpbuf [i] = add(tmpbuf[i], lspcb2[PtrTab_2[1][cluster[1]]][i]);
    } else {
        prev_ana[0] = ana[0] = mode;
        prev_ana[1] = ana[1] = Clust[0];
        prev_ana[2] = ana[2] = Clust[1];
    }
    /* guarantee minimum distance of 0.0012 (~10 in Q13) between tmpbuf[j]
and tmpbuf [j+1] */
    /* compute the quantized lsf vector */
    /* update the prediction memory */
    /* lsf stability check */
    /* convert lsf to lsp */
    return overflow_flag;
}
static Word16 Qnt_e(
            Word16 *errlsf,         /* (i)    : error Lsf vector              */
            Word16 *weight,         /* (i)    : weighting vector              */
            Word16 DIn,             /* (i)    : number of input candidates    */
            Word16 *qlsf,           /* (o)    : quantized error lsf vector    */
            Word16 *Pptr,           /* (o)    : predictor index               */
            Word16 DOut,            /* (i)    : number of quantized vectors   */
            Word16 *cluster,        /* (o)    : quantizer indices             */
            Word16 *MS              /* (i)    : size of the quantizers        */
)
{
    Word16 d_data[2][R_LSFQ*M], best_indx[2][R_LSFQ];
    Word16 ptr_back[2][R_LSFQ], ptr, i;
    Word16 overflow_flag;
    overflow_flag = New_ML_search_1(errlsf, DIn, d_data[0], 4, best_indx[0],
ptr_back[0],
                PtrTab_1, MS[0]);
    if (overflow flag == OVERFLOW) return overflow_flag;
    overflow_flag = New_ML_search_2(d_data[0], weight, 4, d_data[1], DOut,
best_indx[1],
                ptr_back[0], ptr_back[1], PtrTab_2, MS[1]);
    if (overflow_flag == OVERFLOW) return overflow_flag;
    /* backward path for the indices */
    cluster[1] = best_indx[1][0];
    ptr = ptr_back[1][0];
    cluster[0] = best_indx[0][ptr];
    /* this is the pointer to the best predictor */
    *Pptr = ptr_back[0][ptr];
    /* generating the quantized vector */
    Copy(lspcb1[PtrTab_1[cluster[0]]], qlsf, M);
    for (i=0; i<M/2; i++)
        qlsf[i] = add(qlsf[i], lspcb2[PtrTab_2[0][cluster[1]]][i]);
    for (i=M/2; i<M; i++)
        qlsf[i] = add(qlsf[i], lspcb2[PtrTab_2[1][cluster[1]]][i]);
    return NO_OVERFLOW;
}
static Word16 New_ML_search_1(
            Word16 *d_data,         /* (i)    : error vector                  */
            Word16 J,               /* (i)    : number of input vectors       */
            Word16 *new_d_data,     /* (o)    : output vector                 */
            Word16 K,               /* (i)    : number of candidates          */
            Word16 *best_indx,      /* (o)    : best indices                  */
            Word16 *ptr_back,       /* (o)    : pointer for backtracking      */
            Word16 *PtrTab,         /* (i)    : quantizer table               */
            Word16 MQ               /* (i)    : size of quantizer             */
)
{
    Word16 tmp, m, l, p, q, sum[R_LSFQ*R_LSFQ];
    Word16 min[R_LSFQ], min_indx_p[R_LSFQ], min_indx_m[R_LSFQ];
    Word32 acc0;
    Word16 overflow_flag;
    for (q=0; q<K; q++)
        min[q] = MAX_16;
    /* compute the errors */
    for (p=0; p<J; p++)
        for (m=0; m<MQ; m++){
            acc0 = 0;
```

-continued

```
                for (l=0; l<M; l++){
                    tmp = sub(d_data[p*M+l], lspcb1[PtrTab[m]][l]);
                    acc0 = L_mac(acc0, tmp, tmp);
                }
                sum[p*MQ+m] = extract_h(acc0);
                sum[p*MQ+m] = mult(sum[p*MQ+m], Mp[p]);
            }
        /* select the candidates */
        for (q=0; q<K; q++){
            overflow_flag = OVERFLOW;
            for (p=0; p<J; p++)
                for (m=0; m<MQ; m++)
                    if (sub(sum[p*MQ+m], min[q]) < 0){
                        min[q] = sum[p*MQ+m];
                        min_indx_p[q] = p;
                        min_indx_m[q] = m;
                        overflow_flag = NO_OVERFLOW;
                    }
            if (overflow_flag == OVERFLOW)
                return overflow_flag;
            sum[min_indx_p[q]*MQ+min_indx_m[q]] = MAX_16;
        }
        /* compute the candidates */
        for (q=0; q<K; q++){
            for (l=0; l<M; l++)
                new_d_data[q*M+l] = sub(d_data[min_indx_p[q]*M+l],
                                        lspcb1[PtrTab[min_indx_m[q]]][l]);
            ptr_back[q] = min_indx_p[q];
            best_indx[q] = min_indx_m[q];
        }
        return NO_OVERFLOW;
}
static Word16 New_ML_search 2(
                Word16 *d_data,         /* (i)    : error vector                  */
                Word16 *weight,         /* (i)    : weighting vector              */
                Word16 J,               /* (i)    : number of input vectors       */
                Word16 *new_d_data,     /* (o)    : output vector                 */
                Word16 K,               /* (i)    : number of candidates          */
                Word16 *best_indx,      /* (o)    : best indices                  */
                Word16 *ptr_prd,        /* (i)    : pointer for backtracking      */
                Word16 *ptr_back,       /* (o)    : pointer for backtracking      */
                Word16 PtrTab[2][16],   /* (i)    : quantizer table               */
                Word16 MQ               /* (i)    : size of quantizer             */
)
{
        Word16 m, l, p, q, sum[R_LSFQ*R_LSFQ];
        Word16 min[R_LSFQ], min_indx_p[R_LSFQ], min_indx_m[R_LSFQ];
        Word16 tmp1, tmp2;
        Word32 acc0;
        Word16 overflow_flag;
        for (q=0; q<K; q++)
            min[q] = MAX_16;
        /* compute the errors */
        for (p=0; p<J; p++)
            for (m=0; m<MQ; m++){
                acc0 = 0;
                for (l=0; l<M/2; l++){
                    tmp1 = extract_h(L_shl(L_mult (noise_fg_sum[ptr_prd[p]][l],
                                                   noise_fg_sum[ptr_prd[p]][l]), 2));
                    tmp1 = mult (tmp1, weight[l]);
                    tmp2 = sub(d_data[p*M+l], lspcb2[PtrTab[0][m]][l]);
                    tmp1 = extract_h(L_shl(L_mult(tmp1, tmp2), 3));
                    acc0 = L_mac(acc0, tmp1, tmp2);
                }
                for (l=M/2; l<M; l++) {
                    tmp1 = extract_h(L_shl(L_mult (noise_fg_sum[ptr_prd[p]][l],
                                                   noise_fg_sum[ptr_prd[p]][l]), 2));
                    tmp1 = mult(tmp1, weight[l]);
                    tmp2 = sub(d_data[p*M+l], lspcb2[PtrTab[1][m]][l]);
                    tmp1 = extract_h(L_shl(L_mult(tmp1, tmp2), 3));
                    acc0 = L_mac(acc0, tmp1, tmp2);
                }
                sum[p*MQ+m] = extract_h(acc0);
            }
        /* select the candidates */
        for (q=0; q<K; q++){
            overflow_flag = OVERFLOW;
            for (p=0; p<J; p++)
                for (m=0; m<MQ; m++)
```

-continued

```
                if (sub(sum[p*MQ+m], min[q]) < 0){
                    min[q] = sum[p*MQ+m];
                    min_indx_p[q] = p;
                    min_indx_m[q] = m;
                    overflow_flag = NO_OVERFLOW;
                }
        if (overflow_flag == OVERFLOW)
            return overflow_flag;
        sum[min_indx_p[q]*MQ+min_indx_m[q]] = MAX_16;
    }
    /* compute the candidates */
    for (q=0; q<K; q++){
        for (l=0; l<M/2; l++)
            new_d_data[q*M+l] = sub(d_data[min_indx_p[q]*M+l],
                                    lspcb2[PtrTab[0][min_indx_m[q]]][l]);
        for (l=M/2; l<M; l++)
            new_d_data[q*M+l] = sub(d_data[min_indx_p[q]*M+l],
                                    lspcb2[PtrTab[1][min_indx_m[q]]][l]);
        ptr_back[q] = min_indx_p[q];
        best_indx[q] = min_indx_m[q];
    }
    return NO_OVERFLOW;
}
```

And the Cod_cng function

```
static Word16 prev_ana4;
#define OVERFLOW  1
#define NO_OVERFLOW 0
void Cod_cng(
    Word16 *exc,                    /* (i/o)  : excitation array                    */
    Word16 pastVad,                 /* (i)    : previous VAD decision               */
    Word16 *lsp_old q,              /* (i/o)  : previous quantized lsp              */
    Word16 *Aq,                     /* (o)    : set of interpolated LPC coefficients */
    Word16 *ana,                    /* (o)    : coded SID parameters                */
    Word16 freq_prev[MA_NP][M],     /* (i/o)  : previous LPS for quantization       */
    Word16 *seed                    /* (i/o)  : random generator seed               */
)
{
    Word16 i;
    Word16 curAcf[MP1];
    Word16 bid[M], zero[MP1];
    Word16 curCoeff[MP1];
    Word16 lsp_new[M];
    Word16 *lpcCoeff;
    Word16 cur_igain;
    Word16 energyq, temp;
    Word16 overflow_flag = NO_OVERFLOW;
    /* Update Ener and sh_ener */
    for(i = NB_GAIN-1; i>=1; i-- ) {
        ener[i] = ener[i-1];
        sh_ener[i] = sh_ener[i-1];
    }
    /* Compute current Acfs */
    Calc_sum_acf(Acf, sh_Acf, curAcf, &sh_ener[0], NB_CURACF);
    /* Compute LPC coefficients and residual energy */
    if (curAcf[0] == 0) {
        ener[0] = 0;            /* should not happen */
    }
    else {
        Set_zero(zero, MP1);
        Levinson(curAcf, zero, curCoeff, bid, &ener[0]);
    }
    /* if first frame of silence => SID frame */
    if(pastVad != 0) {
        ana[0] = 2;
        count_fr0 = 0;
        nb_ener = 1;
        Qua_Sidgain(ener, sh_ener, nb_ener, &energyq, &cur_igain);
    }
    else {
        nb_ener = add(nb_ener, 1);
        if(sub(nb_ener, NB_GAIN) > 0) nb_ener = NB_GAIN;
        Qua_Sidgain(ener, sh_ener, nb_ener, &energyq, &cur_igain);
        /* Compute stationarity of current filter */
        /* versus reference filter                */
```

-continued

```
        if(Cmp_filt(RCoeff, sh_RCoeff, curAcf, ener[0], FRAC_THRESH1) != 0) {
            flag_chang = 1;
        }
        /* compare energy difference between current frame and last frame */
        temp = abs_s(sub(prev_energy, energyq));
        temp = sub(temp, 2);
        if (temp > 0) flag_chang = 1;
        count_fr0 = add(count_fr0, 1);
        if(sub(count_fr0, FR_SID_MIN) < 0) {
            ana[0] = 0;                 /* no transmission */
        }
        else {
            if(flag_chang != 0) {
                ana[0] = 2;             /* transmit SID frame */
            }
            else{
                ana[0] = 0;
            }
            count_fr0 = FR_SID_MIN; /* to avoid overflow */
        }
    }
    if(sub(ana[0], 2) == 0) {
        /* Reset frame count and change flag */
        count fr0 = 0;
        flag_chang = 0;
        /* Compute past average filter */
        Calc_pastfilt(pastCoeff);
        Calc_RCoeff(pastCoeff, RCoeff, &sh_RCoeff);
        /* Compute stationarity of current filter */
        /* versus past average filter          */
        /* if stationary */
        /* transmit average filter => new ref. filter */
        if(Cmp_filt(RCoeff, sh_RCoeff, curAcf, ener[0], FRAC_THRESH2) == 0) {
            lpcCoeff = pastCoeff;
        }
        /* else */
        /* transmit current filter => new ref. filter */
        else {
            lpcCoeff = curCoeff;
            Calc_RCoeff(curCoeff, RCoeff, &sh_RCoeff);
        }
        /* Compute SID frame codes */
        Az_lsp(lpcCoeff, lsp_new, lsp_old_q); /* From A(z) to lsp */
        /* LSP quantization */
        overflow_flag = lsfq_noise(lsp_new, lspSid_q, freq_prev, &ana;[1]);
        /* undo all the changes for current SID frame, then change
            current frame as noise */
        if (overflow_flag == OVERFLOW){
            cur_igain = ana[4] = prev_ana4;
        }
        else {
            prev_energy = energyq;
            prev_ana4 = ana[4] = cur_igain;
        }
        sid_gain = tab_Sidgain[cur_igain];
    } /* end of SID frame case */
    if(pastVad != 0) {
        cur_gain = sid_gain;
    }
    else {
        cur_gain = mult_r(cur_gain, A_GAIN0);
        cur_gain = add(cur_gain, mult_r(sid_gain, A_GAIN1));
    }
    Calc_exc_rand(cur_gain, exc, seed, FLAG_COD);
    Int_qlpc(lsp_old_q, lspSid_q, Aq);
    for(i=0; i<M; i++) {
        lsp_old_q[i]        = lspSid_q[i];
    }
    /* Update sumAcf if fr_cur = 0 */
    if(fr_cur == 0) {
        Update_sumAcf( );
    }
    return;
}
```

8. Further Preferred Embodiments

Further preferred embodiments adjust the G.729 Annex B functions to handle SID LSF vector quantization overflow by ignoring the LSF vector predictors and directly quantizing the current LSF vector. Indeed, the overflow problem occurs when the predictors differ significantly from the current vector, so ignoring the predictors during overflow should be an improvement.

Preferred embodiments provide two ways to implement the direct quantization of the current LSF vector. First, if the overflow arises at the first stage of quantization (that is, with the New_ML_search_1 function), then use the current LSF vector as the target vector for a two-stage vector quantization with 5 bits for the first stage and 4 bits for the second stage. Contrarily, if the overflow does not arise until the second Annex B stage, then use the current LSF vector as the target vector of a one-stage 7-bit quantization.

9. Modifications

The preferred embodiments may be modified in various ways while retaining the feature of identification of the overflow problem and a fix for the problem.

For example,

G729, Annex B uses the same perceptual weighting function, Get_wegt(lsf, weighting), for both normal speech and for noise. This G729B function is only designed for voice. A new weighting function can be developed using research on noise perception that is also resistant to overflow as well as improving the signal reproduction quality.

What is claimed is:

1. A method of silence frame encoding in G.729 Annex B type encoders, comprising:

(a) detecting a condition in a codebook search which fails to assign a codebook index for output; and (b) compensating for said condition.

2. The method of claim 1, wherein:

(a) said compensating includes assigning a default codebook index.

3. The method of claim 1, wherein:

(a) said compensating includes suppressing a spectral encoding portion of silence frame encoding.

4. The method of claim 1, wherein:

(a) said compensating includes suppressing silence frame encoding.

* * * * *